US011098254B2

(12) United States Patent
Knapper et al.

(10) Patent No.: US 11,098,254 B2
(45) Date of Patent: Aug. 24, 2021

(54) DILUTED BITUMEN PRODUCT WATER REDUCTION

(71) Applicant: SYNCRUDE CANADA LTD. in trust for the owners of the Syncrude Project as such owners exist now and in the future, Calgary (CA)

(72) Inventors: Brian Knapper, Edmonton (CA); Gary Anthieren, Spruce Grove (CA); Sujit Bhattacharya, Edmonton (CA); Tam Tran, Edmonton (CA)

(73) Assignee: SYNCRUDE CANADA LTD. IN TRUST FOR THE OWNERS OF THE SYNCRUDE PROJECT AS SUCH OWNERS EXIST NOW AND IN THE FUTURE, Calgary (CA)

( * ) Notice: Subject to any disclaimer, the term of this patent is extended or adjusted under 35 U.S.C. 154(b) by 0 days.

(21) Appl. No.: 16/930,753

(22) Filed: Jul. 16, 2020

(65) Prior Publication Data

US 2021/0017453 A1 Jan. 21, 2021

Related U.S. Application Data

(60) Provisional application No. 62/875,400, filed on Jul. 17, 2019.

(51) Int. Cl.

| | |
|---|---|
| ***C10G 31/10*** | (2006.01) |
| ***C10G 33/04*** | (2006.01) |
| ***C10G 1/04*** | (2006.01) |

(52) U.S. Cl.

CPC ..... *C10G 1/045* (2013.01); *C10G 31/10* (2013.01); *C10G 33/04* (2013.01); *C10G 2300/802* (2013.01)

(58) Field of Classification Search

CPC ..... C10G 1/047; C10G 1/045; C10G 31/10; C10G 33/04

See application file for complete search history.

(56) References Cited

U.S. PATENT DOCUMENTS

| | | | | |
|---|---|---|---|---|
| 2017/0081592 | A1* | 3/2017 | Spence | C10G 1/047 |
| 2019/0309227 | A1* | 10/2019 | Reid | C10G 1/045 |

FOREIGN PATENT DOCUMENTS

| | | | |
|---|---|---|---|
| CA | 2029795 | A1 | 11/1989 |
| CA | 2217623 | A1 | 10/1997 |
| CA | 2906441 | C | 3/2017 |

* cited by examiner

*Primary Examiner* — Randy Boyer

(74) *Attorney, Agent, or Firm* — Bennett Jones LLP

(57) ABSTRACT

A method for processing bitumen froth comprised of bitumen, water and solids to produce a final diluted bitumen product having a reduced water content is provided whereby demulsifier is added to the bitumen froth after a first separation stage and prior to a second separation stage to produce the final diluted bitumen product having reduced water content.

19 Claims, 6 Drawing Sheets

DILUTED BITUMEN PRODUCT WATER REDUCTION

FIELD OF THE INVENTION

The present invention relates generally to a method for processing bitumen froth to produce a diluted bitumen product having reduced water content. In particular, the invention is related to treating a raw diluent-diluted bitumen with a demulsifier to reduce the water content in the diluted bitumen product without the risk of demulsifier overdosing.

BACKGROUND OF THE INVENTION

Natural oil sand is a complex mixture of sand, water, clay fines and bitumen. A typical composition of oil sand is 10 wt % bitumen, 5 wt % water and 85 wt % solids. Water based extraction processes are used to extract the bitumen from oil sand to produce an extraction product that is referred to in the industry as "bitumen froth". Generally, bitumen froth quality produced from bitumen extraction has a composition of ~60 wt % bitumen, ~30 wt % water and ~10 wt % solids. Examples of bitumen extraction processes include the Clark Hot Water Process, a warm water extraction process as described in Canadian Patent No. 2,029,795, and a low energy process as described in Canadian Patent No. 2,217,623.

Unfortunately, the extraction product (i.e., bitumen froth) is not suitable to feed directly to bitumen processing/upgrading plants. As mentioned, a typical bitumen froth comprises about 60 wt % bitumen, 30 wt % water and 10 wt % solids. Hence, the bitumen froth needs to be first treated before it is suitable for further upgrading. Such treatment is referred to in the industry as "froth treatment". The primary purpose of froth treatment is to remove the water and solids from the bitumen froth to produce a clean diluted bitumen product (i.e., "diluted bitumen" or "dilbit") which can be further processed to produce a fungible bitumen product that can be sold or processed in downstream upgrading units. There are two main types of froth treatment used in the industry today; a naphtha-based froth treatment and a paraffinic-based froth treatment.

Naphtha-based froth treatment processes generally use gravity and centrifugal separation technology. Naphtha is a solvent that is used to change the hydrocarbon viscosity and density properties such that it is more amenable to mechanical separation. Naphtha-based froth treatment processes can supply a high quality diluted bitumen product to the bitumen processing plants while minimizing hydrocarbon losses in the tailings. In naphtha-based froth treatment, naphtha is added to the bitumen froth (which is typically stored in froth tanks) generally at a diluent/bitumen ratio (wt./wt.) of about 0.4-1.0, preferably around 0.7, and then the diluted bitumen froth ("dilfroth") is subjected to gravity separation (gravity-based method) or centrifugal separation (centrifuge-based method) to separate the bitumen from the water and solids.

In centrifugal separation, separation of the bitumen from water and solids may be done by treating the dilfroth in a series of scroll and/or disc stack centrifuges. Alternatively, the dilfroth may be subjected to gravity separation in a series of inclined plate separators ("IPS") in conjunction with countercurrent solvent extraction using added naphtha diluent, followed by disc stack centrifugation. The resultant diluted bitumen products ("dilbit") generally contain between about 0.5 to 0.8 wt % solids and about 2-2.5 wt % water.

For low salinity oil sand ore, e.g., oil sand ore having between about 50-100 ppm chlorides, having 2-2.5 wt % water in the dilbit is sufficiently low to meet the industry standard of 25 ppm chlorides in dry bitumen for upgrading. Dry bitumen is the bitumen product from Diluent Recovery Units after naphtha, water, and light gas oil portions of the dilbit have been removed using atmospheric distillation. The chlorides in oil sand ore is found in the connate water associated with the oil sand, which, assuming approximately 5% water in ore, corresponds to a concentration of chlorides in the connate water of between about 1000-2000 ppm. Additional chlorides are also introduced into bitumen froth (and, ultimately, dilbit) from the recycled process water that is used during water-based bitumen extraction. Presently the process water used for extraction has about 600 ppm chlorides.

However, as higher salinity oil sand ores are mined and processed, e.g., oil sand ore having between about 750-850 ppm chlorides and sometimes as high as 1000 ppm, both the concentration of chlorides in the connate water and the subsequently produced process water produced will rise. It is estimated that 5-25% of the water in the final diluted bitumen product comes from the connate water and the other 75-95% of the chlorides come from the process water. Thus, it is estimated that with high salinity ores, the connate water will average 15,000-17,000 ppm and up to 20,000 ppm and the resultant process water will increase to 1200 ppm. This will result in a much higher chlorides content in the final diluted bitumen product.

It has been shown that the chloride content in dry bitumen is directly related to the water content in diluted bitumen product (dilbit). Thus, higher amounts of water in dilbit can lead to higher amounts of chlorides in dry bitumen. The chlorides are deposited as fine salts in the bitumen as the water is vapourized in the diluent recovery stage. During upgrading of dry bitumen, these salts inevitably hydrolyze at high temperatures in the presence of steam to become hydrochloric acid, which causes high rates of corrosion throughout upgrading. Undetected hydrochloric acid corrosion can result in major upgrading process upsets.

Thus, reducing the water content in dilbit becomes even more critical when mining an oil sand ore that has much saltier connate water (i.e., ores having a very high inorganic chlorides concentration). It is expected that some oil sand ore deposits will have such a high salinity that it is anticipated that the dilbit water content will need to be reduced to 1 wt. % or less to meet the industry standard of 25 ppm chloride in dry bitumen. However, with current bitumen froth treatment regimes, it is not possible to produce dilbit with such reduced water content.

Accordingly, there is a need in the industry for a bitumen froth treatment method that consistently produces a dilbit with a low water content of less than 2 wt. %.

SUMMARY OF THE INVENTION

Historically, the industry has dealt with corrosion problems resulting from undetected hydrochloric acid by upgrading the metallurgy in known acid deposit locations, water washing the areas where it is anticipated that hydrochloric acid will form, and to reduce the amount of residual water reporting from froth treatment. The current naphthenic froth treatment process used at the applicant's facilities operates at a naphtha:bitumen ratio (N:B) of about 0.7 and a temperature of 80° C. and produces a diluted bitumen product that is able to meet the specification of <2.5 wt % water for low salinity oil sand ore. This level of water in the froth treatment product is sufficient to meet upgrading's 25 ppm chloride specification in dry bitumen with the salinity of the current ore body and process water; the chloride content is directly related to the amount of water that reports to the diluted bitumen and the salinity of that water.

Demulsifiers are used as a process aid in naphthenic froth treatment, and are added at a low dosage to the froth pumps feeding both the inclined plate settlers (IPS) and the centrifuges (see FIG. 1). Water content in the product has been shown to decrease as more demulsifier is added to the process; however, the dosage is limited to about 50 ppm due to overdosing, in particular, in the IPS vessels. As used herein, "overdosing" is a condition where, when too much demulsifier is used, there is a substantially increased water and solids content in diluted bitumen product, which is often associated with rag layer formation. Decades of demulsifier development and testing has shown that only incremental improvements in product quality (~20% improvement) can be achieved over this low dosage range, even with optimized chemicals and chemical addition strategies; therefore, froth treatment product water content below about 2% cannot be sustained using the current technology. This is particularly problematic when processing a high salinity oil sand ore.

It was surprisingly discovered that adding demulsifier after the diluent-diluted bitumen froth has been subjected to a first separation stage (e.g., either in a series of gravity settlers or a series of scroll centrifuges) to produce raw diluted bitumen, demulsifier overdosing does not occur when followed by subsequent centrifugation. Therefore, higher dosages of demulsifier can be used, resulting in significant reduction in the froth treatment product water content, and, hence, a reduction of chlorides in the final product. Thus, in one aspect, a method for processing bitumen froth comprised of bitumen, water and solids to produce a final diluted bitumen product having a reduced water content is provided, comprising:

- adding a sufficient amount of a hydrocarbon diluent to the bitumen froth to form a diluted bitumen froth;
- subjecting the diluted bitumen froth to a first separation stage to separate a portion of the water and solids from the diluted bitumen froth to form a raw diluted bitumen;
- adding a sufficient amount of demulsifier to the raw diluted bitumen;
- optionally, subjecting the raw diluted bitumen to a mixing and/or conditioning stage; and
- subjecting the raw diluted bitumen to a second separation stage to produce the final diluted bitumen product having reduced water.

In one embodiment, the first separation stage comprises using at least one gravity separation vessel such as an inclined plate settler. In one embodiment, the first separation stage comprises using at least one centrifuge such as a decanter centrifuge. In one embodiment, the second separation stage comprises using at least one centrifuge such as a disc stack centrifuge.

In one embodiment, the mixing stage comprises using an inline shear mixer. In one embodiment, the mixing stage comprises using a pump.

In one embodiment, the dosage of demulsifier ranges from about 100 ppm to about 1000 ppm, preferably, between about 100 ppm to about 500 ppm.

Additional aspects and advantages of the present invention will be apparent in view of the description, which follows. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described by way of an exemplary embodiment with reference to the accompanying simplified, diagrammatic, not-to-scale drawing.

DETAILED DESCRIPTION OF PREFERRED EMBODIMENTS

The detailed description set forth below in connection with the appended drawing is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practised without these specific details.

The present invention relates generally to a method for processing bitumen froth to produce a diluted bitumen product having reduced water. In order to be suitable for further processing (upgrading) to produce an acceptable bitumen product quality, it is desirable for the dry bitumen product to have less than about 25 ppm chlorides. Because oil sand ore can have a wide range of salt concentrations (chlorides), it is necessary to have a method that can consistently deliver such a dry bitumen product.

As used herein, the term "gravity-based" froth treatment method refers to an operation in which diluted bitumen is separated from water and solids using gravity, and is therefore distinguished from other separation operations such as molecular sieve processes, absorption processes, adsorption processes, magnetic processes, electrical processes, and the like. As used herein, the term "gravity settler" refers to any suitable apparatus that facilitates gravity settling including, but not limited to, a gravity settling vessel and an inclined plate separator ("IPS"). As used herein, the term "IPS" refers to an apparatus comprising a plurality of stacked inclined plates onto which a mixture to be separated may be introduced so that the mixture passes along the plates in order to achieve separation of components of the mixture.

As used herein, the term "centrifuge-based" froth treatment method refers to an operation in which bitumen is separated from water and solids using centrifugal acceleration or centripetal acceleration resulting from rotational movement of a suitable apparatus including, but not limited to, a scroll centrifuge, disc centrifuge, hydrocyclone, propelled vortex separator, and the like.

As used herein, the term "demulsifier" refers to an agent which breaks emulsions or causes water droplets either to coalesce and settle, or to flocculate and settle in flocs. Demulsifiers are commonly formulated from the following types of chemistries: polyglycols and polyglycol esters, ethoxylated alcohols and amines, ethoxylated resin, ethoxylated phenol formaldehyde resins, ethoxylated nonylphenols, polyhydric alcohols, ethylene oxide, propylene oxide block copolymer fatty acids, fatty alcohols, fatty amine and quaternaries and sulfonic acid salts.

Figure 1:
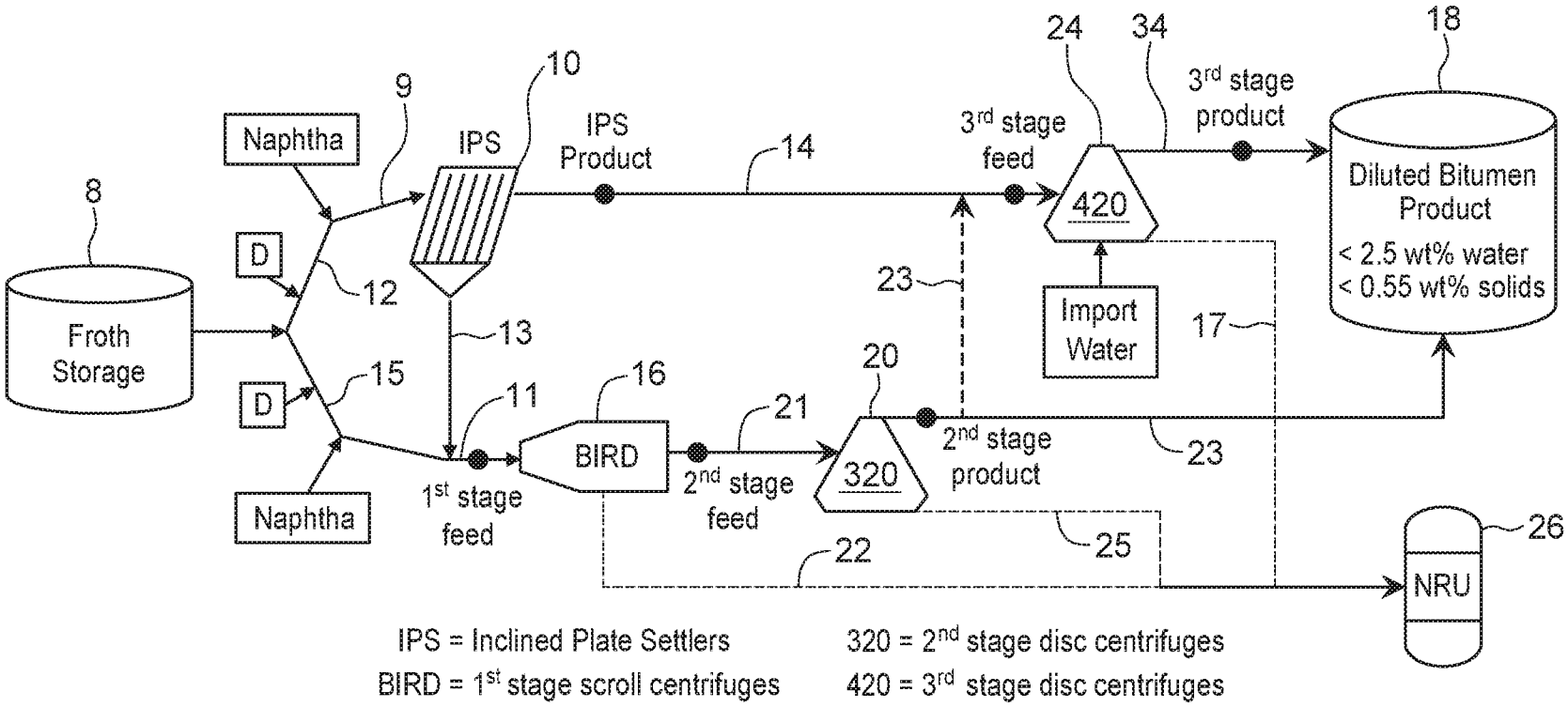
FIG. 1 (Prior Art)
FIG. 1 is a schematic of a prior art method for processing bitumen froth.

FIG. 1 is a general schematic of a prior art naphthenic bitumen froth treatment method, which combines a gravity-based froth treatment method and a centrifuge-based froth treatment method. Bitumen froth is initially received from an extraction facility which extracts bitumen from oil sand using a water based extraction process known in the art a stored in a froth storage tank 8. A first stream of bitumen froth (stream 12) is pumped from the froth storage tank 8 and demulsifier (D) is added to the bitumen froth at a dosage of up to 50 ppm. Naphtha is then added to bitumen froth (stream 12), generally, at a ratio of naphtha solvent to bitumen (by wt %) from about 0.3 to about 1.0. The naphtha-diluted bitumen froth (dilfroth stream 9) is then the subjected to a first separation stage. In this embodiment, the dilfroth is separated in at least one gravity separation vessel 10, illustrated here as an inclined plate settler (IPS), to yield a product stream comprising raw diluted bitumen (stream 14) and at least one by-product stream comprising water and solids, namely tailings (stream 13).

The raw diluted bitumen 14 is then subjected to a second separation stage, for example, using a disc stack centrifuge 24 (e.g., Alfa Laval SX-420 centrifuge), to produce the final diluted bitumen product (stream 34) comprising between about 2.0-2.5 wt % water and about 0.55 wt % solids, and tailings (stream 17). Generally, water 19 at a temperature of about 80° C. is required to be added to disc stack centrifuge 24 to maintain the interface (or e-line) between the hydrocarbon phase and the aqueous phase within the centrifuge itself. This is primarily due to the fact that the raw diluted bitumen (stream 14) product from the IPS only contains about 4% water; this is not volumetrically enough to establish an adequate e-line. The import water all reports to tailings (stream 17), which makes up about 20% of the water that must be treated in naphtha recovery unit (NRU) 26 to remove the naphtha and water from the tailings. Diluted bitumen product (stream 34), is stored in storage tank 18

A second stream of bitumen froth (stream 15) can be simultaneously subjected to a first separation stage comprising using at least one decanter (scroll) centrifuge 16. In this embodiment, demulsifier (D) at a dosage of up to 50 ppm is also added to bitumen froth (stream 15) followed by the addition of naphtha, generally, at a ratio of naphtha solvent to bitumen (by wt %) from about 0.3 to about 1.0. The naphtha-diluted bitumen froth (dilfroth stream 11) is then subjected to separation in at least one decanter (Bird) centrifuge 16 to yield a product stream comprising raw diluted bitumen (stream 21) and at least one by-product stream comprising water and solids, namely tailings 22. In one embodiment, the tailings 13 from the IPS 10 can be added to dilfroth stream 11 prior to separation in decanter centrifuge 16.

In this embodiment, raw diluted bitumen 21 is subjected to a second separation stage in a disc stack centrifuge 20 (e.g., Alfa Laval SX-320 centrifuge) to produce diluted bitumen product 23 comprising between about 2.0-2.5 wt % water and about 0.55 wt % solids, and tailings 25. Tailings 22 and tailings 25 are treated in a naphtha recovery unit (NRU) 26 to remove the naphtha and water from the tailings. Optionally, diluted bitumen product 23 can be subjected to a third separation stage by mixing diluted bitumen product 23 with raw diluted bitumen 14 produced in IPS 10 and subjecting the mixture to separation in disc stack centrifuge 24.

The final diluted bitumen product (stored in storage tank 18) is generally transferred to a diluent recovery unit (not shown) where naphtha is recovered, recycled and reused. The bitumen may be further treated in a fluid coker or ebullating-bed hydrocracker ("LC-Finer") and may be further processed into a synthetic crude oil product by means not shown but disclosed in the art.

Unfortunately, the addition of demulsifier prior to the first separation stage as taught in the prior art naphthenic froth treatment of FIG. 1 can only achieve between about 2.0-2.5% water content in the final diluted bitumen product. This is primarily due to the discovery that, while higher demulsifier dosages reduces water content, it can lead to overdosing, in particular, in the IPS. Thus, dosage is limited to 50 ppm. In the present invention, however, high dosages of demulsifier can be used without the risk of overdosing.

Figure 2:
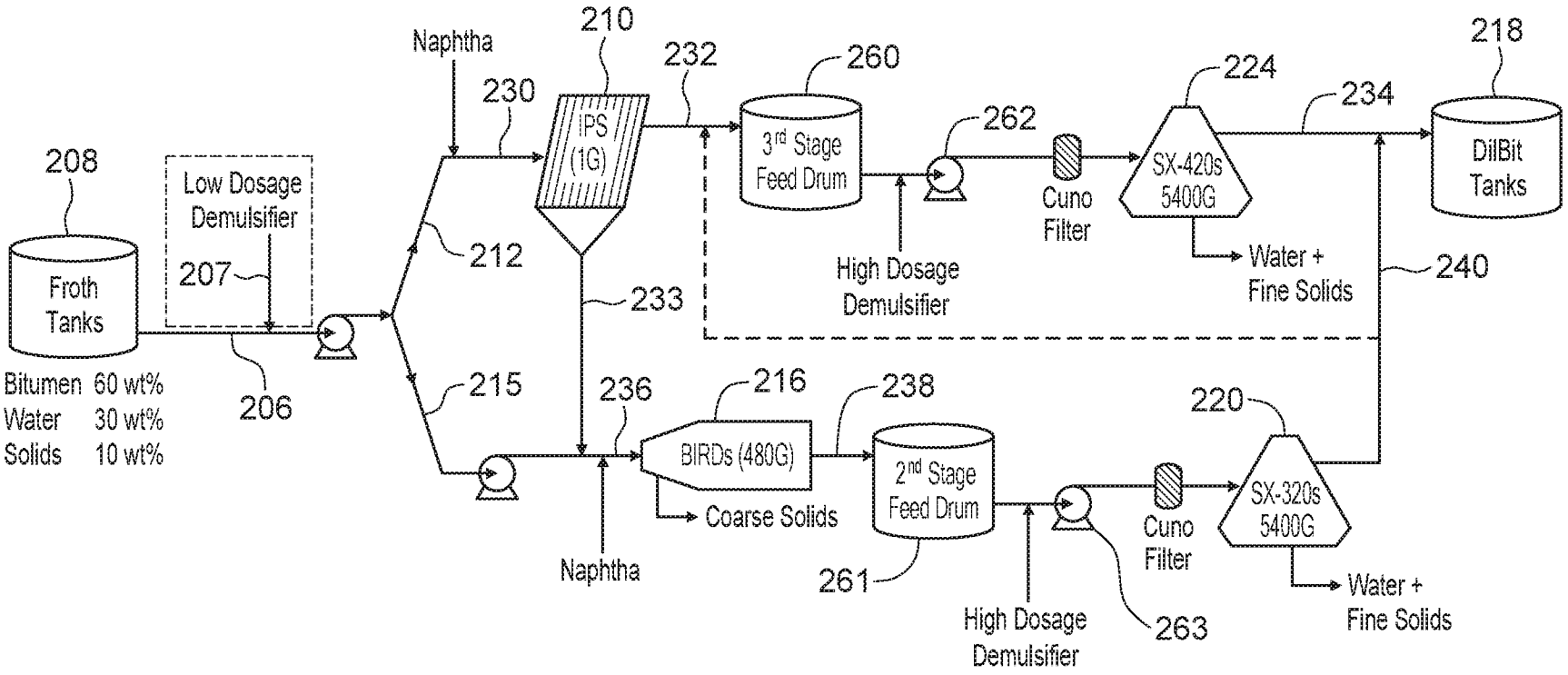
FIG. 2 is a schematic of an embodiment of a method for processing bitumen froth according to the present invention.

FIG. 2 shows one embodiment of a naphthenic bitumen froth treatment method of the present invention. Bitumen froth is initially received from an extraction facility which extracts bitumen from oil sand using a water based extraction process known in the art a stored in a froth storage tank 208. A stream of bitumen froth (stream 206) is pumped from the froth storage tank 208 and, optionally, a low dosage of demulsifier (e.g., 50 ppm) can be added thereto. Stream 206 is split into two distinct streams. Naphtha is added to first bitumen froth stream 212, generally, at a ratio of naphtha solvent to bitumen (by wt %) from about 0.3 to about 1.0. The naphtha-diluted bitumen froth (dilfroth stream 230) is then the subjected to a first separation stage. In this embodiment, the dilfroth 230 is separated in at least one gravity separation vessel 210, illustrated here as an inclined plate settler (IPS), to yield a product stream comprising raw diluted bitumen (stream 232) and at least one by-product stream comprising water and solids, namely tailings (stream 233). The raw diluted bitumen stream 232 is temporarily stored in feed drum 260 and demulsifier is added to the raw diluted bitumen 232. The demulsifier/raw diluted bitumen mixture is optionally mixed (for example, in pump 262) and then subjected to a second stage separation step in a disc stack centrifuge 224 (e.g., Alfa Laval SX-420 centrifuge) to produce the diluted bitumen product (stream 234), which is stored in storage tank 218.

A second stream of bitumen froth (stream 215) can be simultaneously subjected to a first separation stage comprising using at least one decanter centrifuge 216. In this embodiment, naphtha, generally, at a ratio of naphtha solvent to bitumen (by wt. %) from about 0.3 to about 1.0, is added to bitumen froth 215 and the naphtha-diluted bitumen froth (dilfroth stream 236) is then subjected to separation in at least one decanter (Bird) centrifuge 216 to yield a product stream comprising raw diluted bitumen (stream 238). In one embodiment, the tailings 233 from the IPS 210 can be added to dilfroth stream 236 prior to separation in decanter centrifuge 216. The raw diluted bitumen stream 238 is temporarily stored in feed drum 261 and demulsifier is added to the raw diluted bitumen 238. The demulsifier/raw diluted bitumen mixture is optionally mixed (for example, in pump 263) and then subjected to a second stage separation step in a disc stack centrifuge 220 (e.g., Alfa Laval SX-320 centrifuge) to produce the diluted bitumen product (stream 240), which is stored in storage tank 218. In one embodiment, a portion of the diluted bitumen product stream 240 is reprocessed in disc stack centrifuge 224.

The diluted bitumen products generally comprise less than 1 wt % water and less than 0.55 wt % solids. It is understood that the overall operating strategy will be to produce a dry bitumen product having <25 ppm chlorides and that the method can be adjusted accordingly, depending upon the chlorides content in the oil sand ore and process water. The final diluted bitumen product (stored in storage tank 218) is generally transferred to a diluent recovery unit (not shown) where naphtha is recovered, recycled and reused. The bitumen may be further treated in a fluid coker or ebullating-bed hydrocracker ("LC-Finer") and may be further processed into a synthetic crude oil product by means not shown but disclosed in the art.

In addition to producing a final diluted bitumen product with a lower water content and, hence, a lower chlorides content, because, in most instance, no demulsifier is added prior to the first separation step (in IPS 210), this results in high IPS product water (in the raw diluted bitumen), thus, reducing the need to import water to the second separation stage, i.e., the polishing centrifuges).

Figure 3:
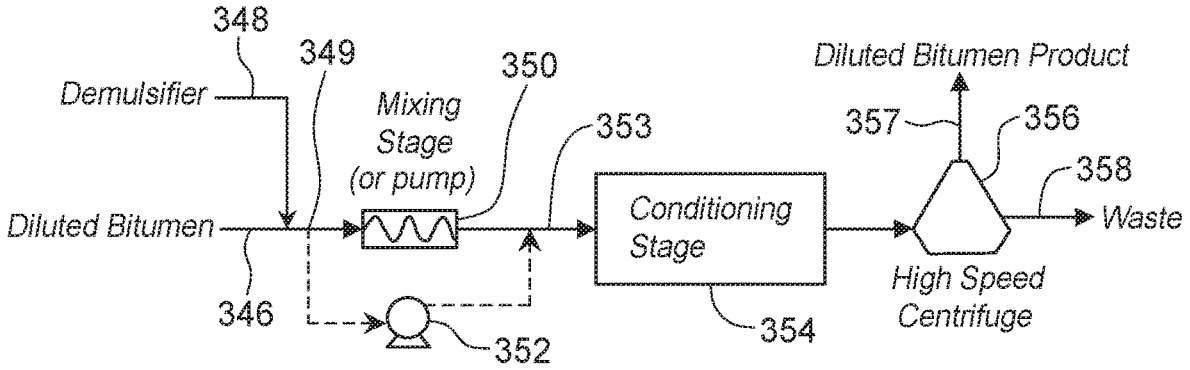
FIG. 3 is a schematic of an embodiment of the components for injecting demulsifier in the bitumen froth treatment method of the present invention.

FIG. 3 is a schematic of an embodiment of components for injecting demulsifier into the raw diluted bitumen feed to disc centrifuges. In this embodiment, demulsifier 348 is added to the raw diluted bitumen 346 and the demulsifier-raw diluted bitumen 349 is then subjected to a mixing stage using either an in-line mixer 350 or a pump 352. The resultant mixture 353 may then be subjected to a longer residence conditioning stage 354, for example, by providing additional residence time in a pipe, using one or more low-shear static mixers, using a gently stirred tank, or a surge tank, prior to separation in a high speed centrifuge 356, such as a disc centrifuge, to produce diluted bitumen product 357 and water and solids tailings (waste) 358. The longer residence conditioning stage is to give the demulsifier time to flocculate/coalesce droplets and create gentle flow patterns that will increase the probability of droplet-droplet collisions.

Example 1

Simulated centrifuge testing (hot spin) was conducted on diluted froth to show the effect of demulsifier dosage [ppm] on product water/solids content [wt %] and product chlorides content [ppm]. Preheated bitumen froth and naphtha were mixed with an impeller in a jar at N:B ratio of 0.7 and a temperature of 60° C. After 10 minutes of mixing, demulsifier was added to the jar at a specific dosage and mixing continued. After 10 more minutes of mixing, triplicate "hot spin" samples were taken into centrifuge tubes, the centrifuge tubes were quickly heated to 80° C. and subsequently spun at 80° C. in a hot spin centrifuge. The "hot spun" hydrocarbon layers were analyzed for water content, solids content, and chlorides content. This test was repeated for every dosage depicted in FIG. 4. Triplicate blank (0 ppm) hot spin samples were taken for every experiment after the first 10 minutes of mixing, just prior to demulsifier addition, to establish the demulsifier-free product quality. The demulsifier used was a commercially available demulsifier having the tradename Emulsotron X-2105, manufactured by Nalco-Champion.

Figure 4:
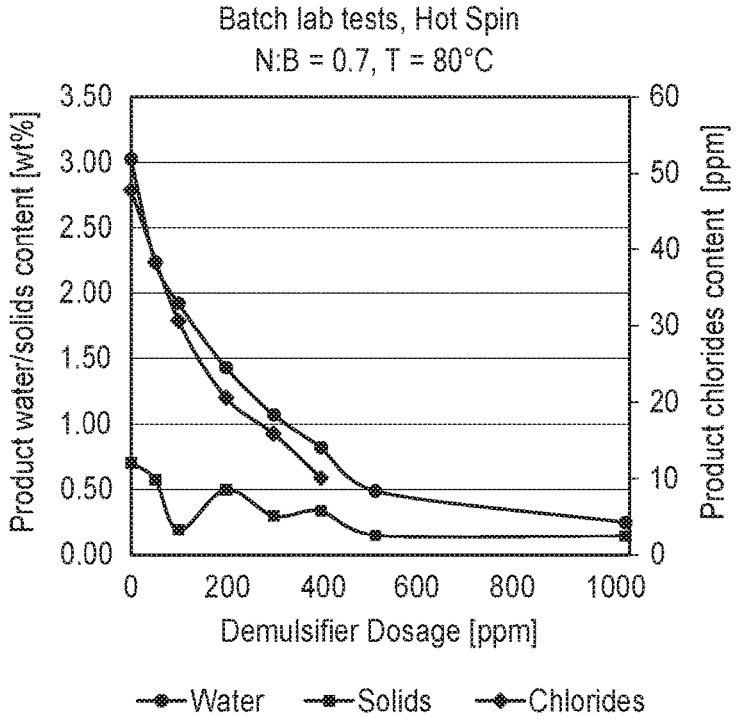
FIG. 4 is a graph showing the water [wt %], solids [wt %] and chlorides [ppm] content versus demulsifier dosage [ppm] in simulated centrifuge testing in the laboratory.

FIG. 4 shows that when 0 ppm demulsifier was used, the water content in the diluted bitumen product was about 3 wt %, the solids content about 0.8 wt % and the chlorides content was about 52 ppm. This would result in a diluted bitumen product that would be unsuitable for upgrading. However, when 400 ppm demulsifier was used, the water content dropped to 0.8 wt %, the solids content dropped to 0.4 wt % and the chlorides content dropped to about 10 ppm. This resulted in a diluted bitumen product that meets the 25 ppm chlorides maximum. FIG. 4 also shows continued water and solids reduction with a demulsifier dosage of 500 ppm and 1000 ppm, indicating that no chemical overdosing was occurring.

Example 2

Commercial-scale tests were performed at one of the applicant's froth treatment plants on two separate days. Demulsifier was added before the second separation stage, namely, before the disc centrifuges A, B, C, and G (each a SX-320 centrifuge), which follow decanter (Bird) centrifuge. Data from the online watercut meter, which measures the water in the product of disc centrifuge B, is included to show that the response of the water cut meter is accurate and representative of the samples taken for lab analyses. The demulsifier used was a commercially available demulsifier having the tradename Emulsotron X-2105, manufactured by Nalco-Champion.

Figure 5A:
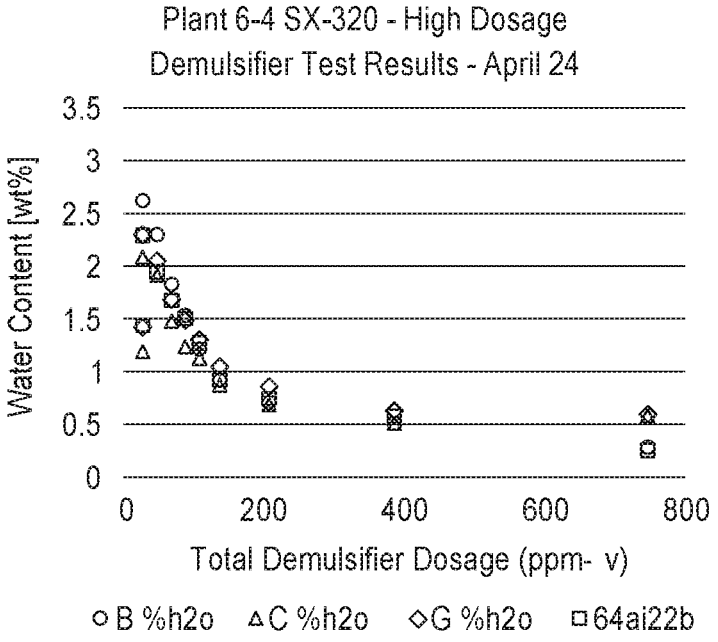
FIGS. 5A and 5B are graphs from plant tests showing the water content [wt %] versus total demulsifier [ppm-v] for two separate days, respectively, using the bitumen froth treatment method of the present invention.
Figure 5B:
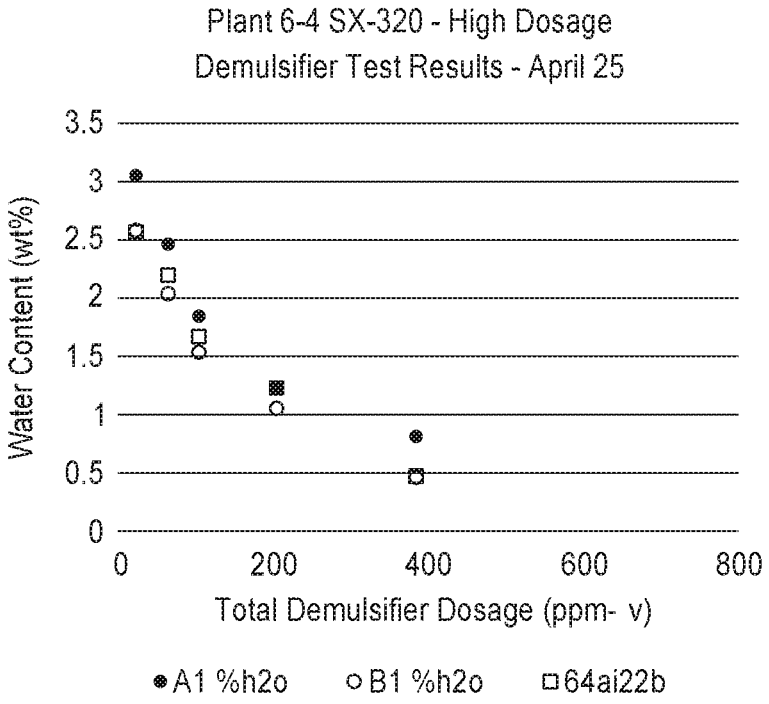

FIGS. 5A and 5B clearly show that the water content in the final diluted bitumen product was demulsifier dosage dependent and that water content (wt %) could be reduced to less than 1 wt % with a demulsifier dosage of 200 ppm. Water content was reduced to 0.5 wt % and below when using 400 ppm and 800 ppm demulsifier, respectively, without any showing of demulsifier overdosing.

Figure 6:
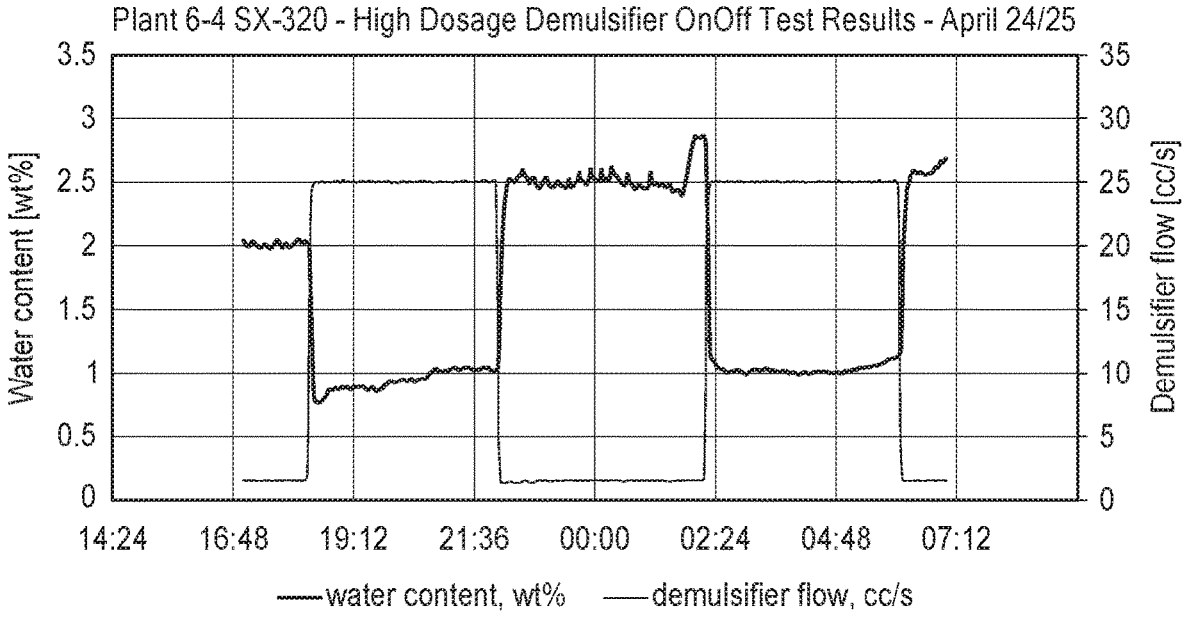
FIG. 6 shows the results of an extended on/off high-dosage demulsifier [200 ppm] testing in SX-320 centrifuges using the bitumen froth treatment method of the present invention.

FIG. 6 shows the response of the watercut meter on the product of disc centrifuge B for extended on/off testing at one of the applicant's froth treatment plants using 200 ppm demulsifier. The results clearly show that the water content [wt %] in diluted bitumen product decreased to about 1 wt % when 200 ppm demulsifier was added over time and that when demulsifier addition was stopped, the water content rose to about 2.5 wt %. FIG. 6 also shows that product quality excursion due to chemical overdosing did not occur when using a dosage of 200 ppm, froth basis. "Froth Basis" means taking the total diluted bitumen froth feed rate to the centrifuges and subtracting the portion of the feed that was naphtha. The demulsifier flow rate was divided by the naphtha-excluded centrifuge feed rate to give the dosage. This was done in order to report dosages that are reasonably comparable to what is currently being used in the plant, that is, demulsifier flow rate divided by froth flow rate.

Example 3

Figure 7:
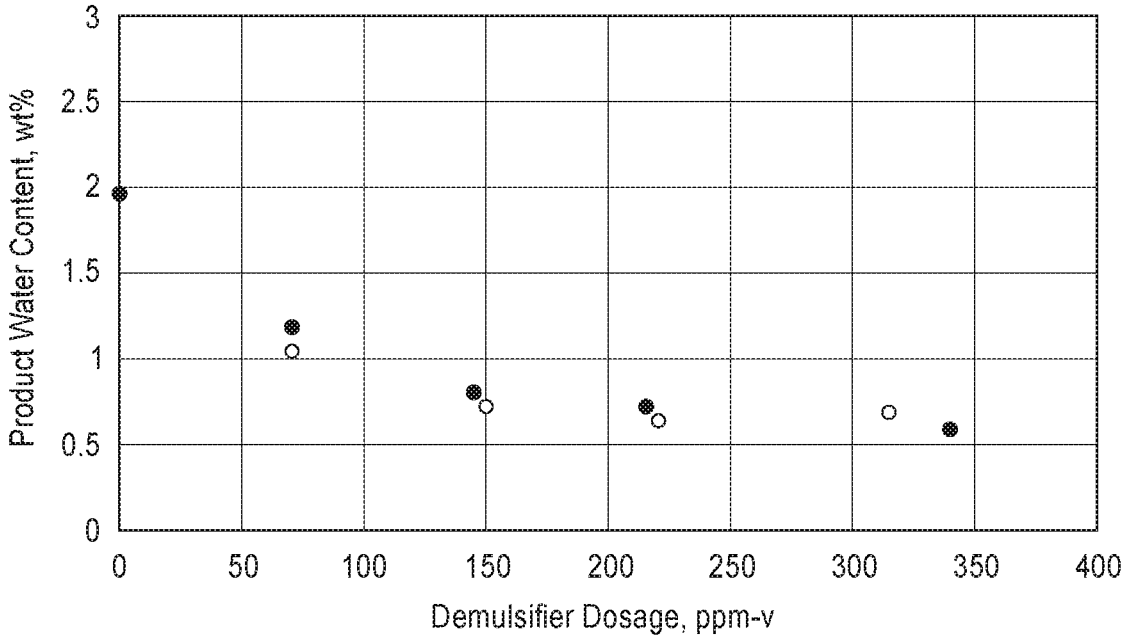
FIG. 7 is a graph that shows that when adding demulsifier after the first separation stage in IPS and prior to the second separation stage, namely, SX-420 disc centrifuges, the water content in the final diluted bitumen product was demulsifier dosage dependent.

Commercial-scale tests were performed at one of the applicant's froth treatment plant by adding demulsifier after the first separation stage in IPS and prior to the second separation stage, namely, SX-420 disc centrifuges. The demulsifier used was a commercially available demulsifier having the tradename Emulsotron X-2105, manufactured by Nalco-Champion. FIG. 7 shows that the water content in the final diluted bitumen product was demulsifier dosage dependent and that water content (wt %) could be reduced to less than 1 wt % with a demulsifier dosage of 150 ppm. Water content was reduced to almost 0.5 wt % when using 340 ppm demulsifier.

Example 4

Figure 8:
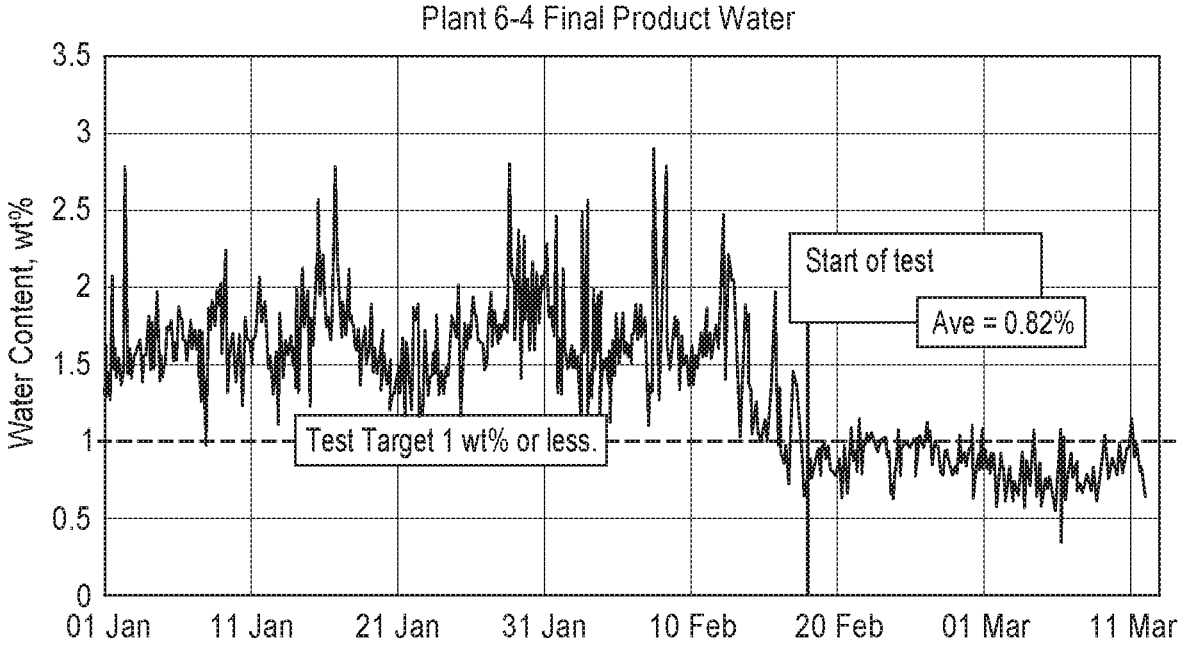
FIG. 8 is a graph comparing the long term water content in the final diluted bitumen product when using the prior art demulsifier dosing regimen versus the demulsifier dosing regimen of the present invention.

In one of the applicant's commercial-scale froth treatment plants (Pant 6-4), the water content in the final diluted bitumen product (i.e., the pooled diluted bitumen product in the final dilbit tank) was monitored over a period of 49 days using prior art demulsifier addition (as shown in FIG. 1) at a demulsifier dosage between 5-25 ppm-v on a froth basis. Over the next 24 days, demulsifier addition of the present invention (as shown in FIG. 2) was used at a demulsifier dosage of 105 ppm in the SX-420 feed and 155 ppm in the SX-320 feed on a "total stream basis", which is approximately 170 ppm and 205 ppm on a froth basis. The test target was set at a water content in the final product of 1 wt % or less. FIG. 8 shows that when using the prior art demulsifier addition for the first 49 days, the average water content in the final product was well above the 1 wt % target, averaging about 1.8 wt %. However, when the plant was operated using the demulsifier addition of the present invention for the next 24 days, it can be seem that the final product water was consistently 1 wt % or lower, the average water content being around 0.82 wt %. This demonstrates that there are no long term impacts of high dosage demulsifier when added after the first stage separation but before the second stage separation.

In summary, the benefits of the present invention are at least two-fold; first, there was a significant reduction in the water content of the final diluted bitumen product, and, hence, reduced chlorides content; and, second, the water content in the raw diluted bitumen produced after first stage separation in IPS was increased, thereby reducing or eliminating the need for import water when polishing the raw diluted bitumen in disc centrifuges.

From the foregoing description, one skilled in the art can easily ascertain the essential characteristics of this invention, and without departing from the spirit and scope thereof, can make various changes and modifications of the invention to adapt it to various usages and conditions. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

The invention claimed is:

1. A method for processing bitumen froth comprised of bitumen, water and solids to produce a final diluted bitumen product having a reduced water content, comprising:

adding a hydrocarbon diluent at a ratio of hydrocarbon diluent to bitumen from about 0.3 wt % to about 1.0 wt % to the bitumen froth to form a diluted bitumen froth;

subjecting the diluted bitumen froth to a first separation stage to separate a portion of the water and solids from the diluted bitumen froth to form a raw diluted bitumen;

adding a demulsifier at a dosage range of about 100 ppm to about 1000 ppm to the raw diluted bitumen;

optionally, subjecting the raw diluted bitumen to a mixing and/or conditioning stage; and subjecting the raw diluted bitumen to a second separation stage to produce the final diluted bitumen product having reduced water content.

2. The method of claim 1, wherein the first separation stage comprises using at least one gravity separation vessel.

3. The method of claim 2, wherein the at least one gravity separation vessel is an inclined plate settler.

4. The method of claim 1, wherein the first separation stage comprises using at least one centrifuge.

5. The method of claim 4, wherein the at least one centrifuge is a decanter centrifuge.

6. The method of claim 1, wherein the second separation stage comprise s using at least one centrifuge.

7. The method of claim 6, wherein the at least one centrifuge comprises a disc stack centrifuge.

8. The method of claim 1, wherein the mixing stage comprises using an inline shear mixer.

9. The method of claim 1, wherein the mixing stage comprises using a pump.

10. The method of claim 1, wherein the dosage of demulsifier ranges from about 100 ppm to about 500 ppm.

11. The method of claim 1, wherein the water content in the final diluted bitumen product is less than about 1 wt %.

12. The method of claim 2, wherein the second separation stage comprises using at least one centrifuge.

13. The method of claim 3, wherein the second separation stage comprises using at least one centrifuge.

14. The method of claim 4, wherein the second separation stage comprises using at least one centrifuge.

15. The method of claim 5, wherein the second separation stage comprises using at least one centrifuge.

16. The method of claim 12, wherein the at least one centrifuge comprises a disc stack centrifuge.

17. The method of claim 13, wherein the at least one centrifuge comprises a disc stack centrifuge.

18. The method of claim 14, wherein the at least one centrifuge comprises a disc stack centrifuge.

19. The method of claim 15, wherein the at least one centrifuge comprises a disc stack centrifuge.

* * * * *